United States Patent [19]

Meetham et al.

[11] 4,374,084

[45] Feb. 15, 1983

[54] ALLOY COMPOSITION SUITABLE FOR USE IN MAKING CASTINGS, AND A CASTING MADE THEREFROM

[75] Inventors: Geoffrey W. Meetham, Allestree; John D. Gray, Newbold, both of England

[73] Assignee: Rolls-Royce Limited, London, England

[21] Appl. No.: 249,977

[22] Filed: Apr. 1, 1981

[30] Foreign Application Priority Data

May 1, 1980 [GB] United Kingdom ..... 8014554

[51] Int. Cl.[3] ..... C22C 19/05

[52] U.S. Cl. ..... 420/449; 420/448

[58] Field of Search ..... 75/171, 170; 148/32, 148/32.5

[56] References Cited

FOREIGN PATENT DOCUMENTS 955016 4/1964 United Kingdom .

*Primary Examiner*—R. Dean

*Attorney, Agent, or Firm*—Cushman, Darby & Cushman

[57] ABSTRACT

An alloy is described which is suitable for the manufacture of castings which operate under high temperature conditions (such as nozzle guide vanes for gas turbine engines) but which can also be welded satisfactorily. The alloy comprises

| | |
|---|---|
| Chromium | 14.5–16.5% |
| Cobalt | 9–11% |
| Molybdenum | 5.5–8% |
| Aluminium | 1.5–3% |
| Titanium | 1.5–3% |
| Tantalum | 0–1% |
| Niobium | 0–1% |
| Boron | 0.004–0.008% |
| Iron | 0–0.5% |
| Manganese | 0–0.4% |
| Silicon | 0–0.2% |
| Nitrogen | 0–0.5% |
| Carbon | 0.11–0.18% |

The balance being Nickel apart from incidental impurities.

4 Claims, 3 Drawing Figures

ALLOY COMPOSITION SUITABLE FOR USE IN MAKING CASTINGS, AND A CASTING MADE THEREFROM

BACKGROUND OF THE INVENTION

This invention relates to an alloy composition suitable for use in making castings, and to a casting made therefrom.

In the past, a variety of nickel-based superalloys have been invented for use as casting materials, in particular for various uses in gas turbine engines. One such alloy is that claimed in our prior British Pat. No. 955016, this alloy being highly temperature and corrosion resistant and having been successful in its preferred application as a material for the cast nozzle guide vanes of gas turbine engines.

It is an unfortunate fact that the casting process does not always produce ideal results; thus for instance casting defects are sometimes found in cast superalloy objects. If this happens, it is clearly economical if the defects can be welded up rather than scrapping the faulty casting. Unfortunately the alloy mentioned above does not lend itself to the welding process and in consequence the repair of faulty castings and of articles damaged in service has been difficult.

In particular, like all alloys which are difficult to weld, the above-mentioned alloy is prone to cracking in the heat affected zone round the periphery of the weld.

Each of the graphs represent values for 3 alloy materials: the Datum alloy, in accordance with UK Pat. No. 955,016; Stellite 31, a commonly used Nickel-based superalloy; and Alloy 3, which is in accordance with the present invention.

DETAILED DESCRIPTION OF THE INVENTION

We have now discovered that by altering the constituents of the alloy referred to above, it is possible to produce an alloy whose material properties are not significantly affected but which becomes much more easily weldable.

According to the present invention an alloy suitable for casting consists essentially of, by weight percent

| | |
|---|---|
| Chromium | 14.5–16.5% |
| Cobalt | 9–11% |
| Molybdenum | 5.5–8% |
| Aluminium | 1.5–3% |
| Titanium | 1.5–3% |
| Tantalum | 0–1% |
| Niobium | 0–1% |
| Boron | 0.004–0.008% |
| Iron | 0–0.5% |
| Manganese | 0–0.4% |
| Silicon | 0–0.2% |
| Nitrogen | 0–0.5% |
| Carbon | 0.11–0.18% |

The balance being essentially Nickel apart from incidental impurities.

A preferred embodiment of the present invention comprises an alloy consisting essentially of by weight percent.

| | |
|---|---|
| Chromium | 15% |
| Cobalt | 10% |
| Molybdenum | 6.5% |
| Aluminium | 2.5% |
| Titanium | 2.5% |
| Boron | 0.006% |
| Carbon | 0.15% |

The balance being essentially Nickel plus incidental impurities.

The invention also includes a casting, in particular a cast nozzle guide vane for a gas turbine engine, made of the alloy in accordance with the invention.

DESCRIPTION OF THE PREFERRED EMBODIMENTS

The invention will now be particularly described, merely by way of example, making reference to the accompanying drawings.

Figure 1:
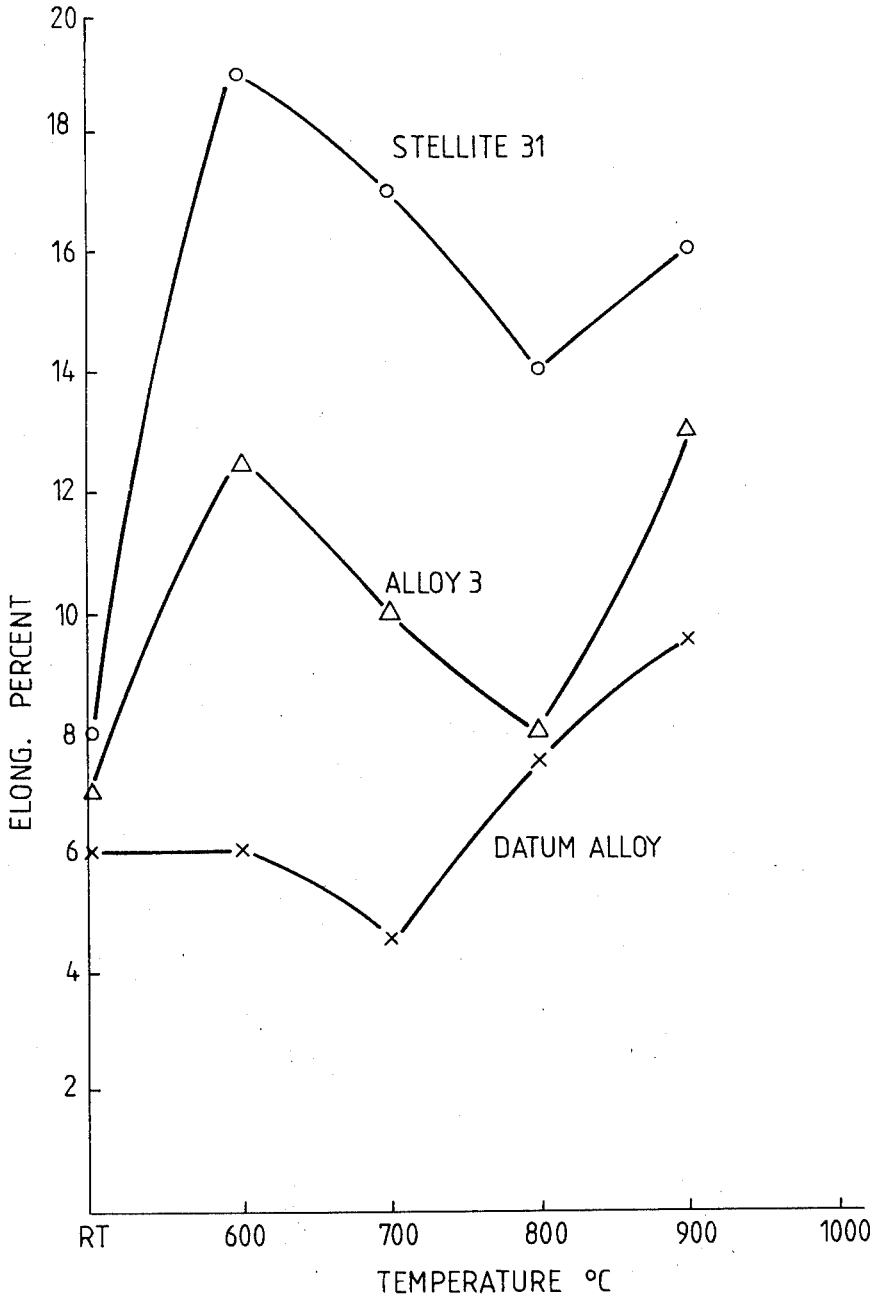
FIG. 1 is a graph plotting temperature against percent elongation, a measure of tensile ductility.
Figure 2:
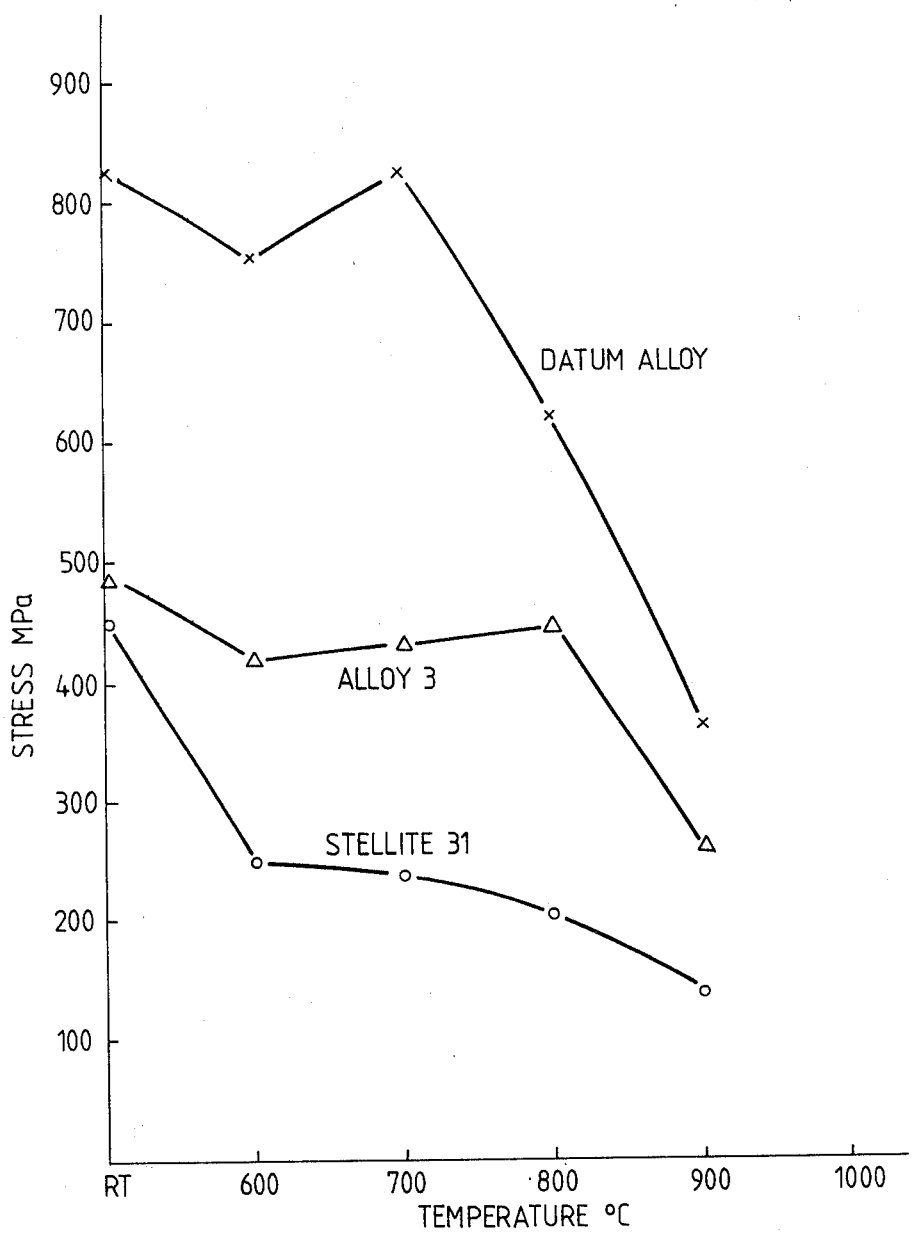
FIG. 2 is a graph representing stress plotted against temperature, a measure of tensile strength.
Figure 3:
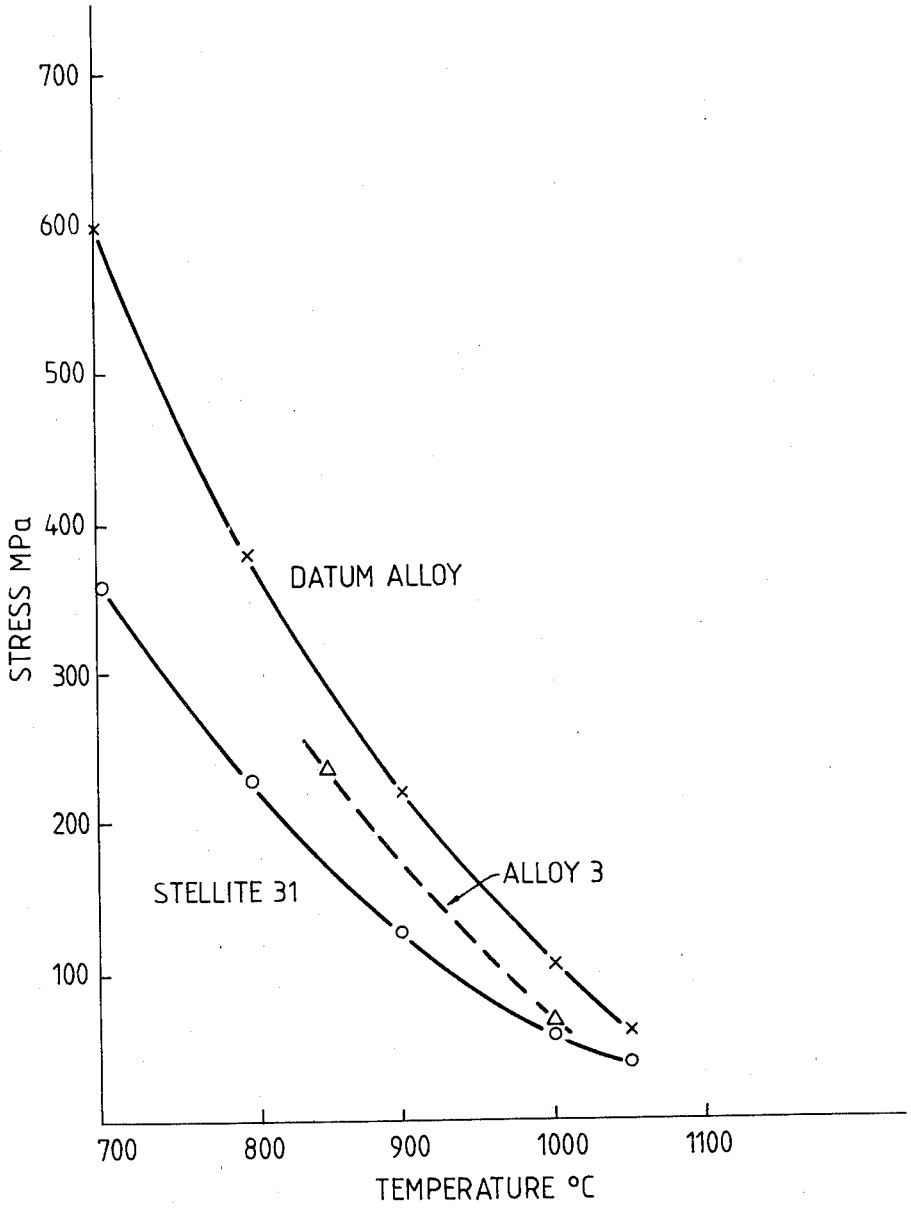
FIG. 3 is a graph comparting stress rupture against temperature.

In the accompanying drawings FIGS. 1, 2 and 3 are graphs indicating the tensile ductility, stress rupture and tensile properties of three materials, one in accordance with British Pat. No. 955016, one in accordance with the present invention and one being a commonly used Nickel-based superalloy known as Stellite 31.

In order to test the invention, a series of alloys were tested having differing modifications of the composition of British patent 955016 and the ability of test pieces of these alloys to be welded was determined.

The alloys produced were as follows (all alloys were Nickel based).

| | Cr | Co | Mo | Al | Ti | B | C | Nv |
|---|---|---|---|---|---|---|---|---|
| Datum Alloy (as B.P. 955016) | 15 | 10 | 8 | 4 | 3.5 | 0.006 | 0.15 | 2.5 |
| Alloy 1 | 15 | 10 | 6.5 | 3.9 | 3.7 | 0.006 | 0.15 | 2.35 |
| Alloy 2 | 15 | 10 | 6.5 | 3.5 | 3.0 | 0.006 | 0.15 | 2.2 |
| Alloy 3 | 15 | 10 | 6.5 | 2.5 | 2.5 | 0.006 | 0.15 | 2.0 |

Each of these alloys was used to cast a test piece in the form of a hollow aerofoil vane for a gas turbine engine. The vanes were then deliberately damaged and repaired by an argon arc welding technique. It became clear that some of the test alloys would not even produce an initially satisfactory weld, and the welded vane test pieces were then subjected to a simulated production thermal cycle of 1 hour at 1000° C.

The condition of the as-formed weld and the weld after the thermal cycle are set out in the table below:

| Alloy | No. of weld tests | Heat affected zone cracking: No. cracked after welding | Heat affected zone cracking: No. cracked after heat treatment |
|---|---|---|---|
| Datum Alloy | 5 | 0 | 5 |
| Alloy 1 | 4 | 2 | 4 |
| Alloy 2 | 4 | 0 | 4 |
| Alloy 3 | 5 | 0 | 0* |

*1 small crack in weld itself - not heat affected zone cracking

It will be seen that alloy 3 which is the only alloy in accordance with the present invention provides much better weldability than any of the other alloys. It will be noted from the table of alloy constituents that $N_v$, the electron vacancy number, is relatively low for this alloy and in fact we believe that a value of $N_v$ in the region of 2.0 is essential for the alloy to be weldable to a useful degree.

Having determined that the alloy of the invention is weldable, it is necessary to demonstrate that the other properties remain useful. In order to check this, the alloy in accordance with the invention (Alloy 3 above) was tested against the datum alloy and against a common alloy used for similar purposes known as Stellite 31. This alloy comprises nominally by weight percent.

| | |
|---|---|
| Chromium | 25.0–26.5% |
| Tungsten | 7.0–8.0% |
| Iron | 0.0–2.0% |
| Boron | 0.000–0.008% |
| Nickel | 9.5–11.5% |
| Carbon | 0.4–0.6% |
| Silicon | 0.5–1.0% |
| Cobalt | Remainder |

As shown in FIG. 1 of the enclosed drawings, the first test related to the tensile ductility of the alloys. Here test pieces were broken under tension at various temperatures, and the elongation of the specimen at fracture was determined. It will be seen that the results for Alloy 3, while worse than those for the Stellite 31 are better than the datum alloy which service experience has established as being at an adequate level.

Next the ultimate tensile strength of the same three materials was determined at various temperatures. This is carried out using the same test referred to above in connection with FIG. 1, but here the stress required to break the test piece is recorded. FIG. 2 shows these results, and here again Alloy 3 is seen to give properties lying between those for Stellite 31 and the datum alloy, although in this case the datum alloy has the best properties while Stellite 31 has the worst.

The third test determined the stress rupture properties of the materials, that is a measure of the load which can be borne by the test pieces in the long term at elevated temperatures. In FIG. 3 the stress at which the alloy can last for 100 hours is plotted against the temperature, and it will again be seen that the results for Alloy 3 lie between those for the datum alloy (which had the best properties) and those from Stellite 31 (which had the worst properties).

These tests demonstrate that the alloy of the present invention, although slightly inferior in some respects to the existing alloys, provides a very good balance of properties and is relatively easily weldable, and is thus a very useful alloy. It should be noted that although one alloy within the invention is described above, it is clear that the main effect on weldability of the alloy is produced by the variation in $N_v$ number, and the range claimed has been determined to be such as to maintain weldability without adversely affecting other properties. The content of Molybdenum Aluminium and Titanium is reduced, again to lower $N_v$ number and hence to enhance weldability, but the ranges for the other constituents will be seen to be similar to those explained in British Pat. No. 955016.

We claim:

1. An alloy suitable for casting and consisting essentially of by weight percent:

| | |
|---|---|
| Chromium | 14.5–16.5% |
| Cobalt | 9–11% |
| Molybdenum | 5.5–8% |
| Aluminium | 1.5–3% |
| Titanium | 1.5–3% |
| Tantalum | 0–1% |
| Niobium | 0–1% |
| Boron | 0.004–0.008% |
| Iron | 0–0.5% |
| Manganese | 0–0.4% |
| Silicon | 0–0.2% |
| Nitrogen | 0–0.5% |
| Carbon | 0.11–0.18% |

balance essentially Nickel apart from incidental impurities

2. An alloy as claimed in claim 1 and consisting essentially of by weight percent:

| | |
|---|---|
| Chromium | 15% |
| Cobalt | 10% |
| Molybdenum | 6.5% |
| Aluminium | 2.5% |
| Titanium | 2.5% |
| Boron | 0.006% |
| Carbon | 0.15% |

balance essentially Nickel apart from incidental impurities

3. A casting made of the alloy of claim 1 or 2.

4. A nozzle guide vane for a gas turbine engine comprising a casting as claimed in claim 3.

* * * * *